US008677886B2

(12) United States Patent
Cronin et al.

(10) Patent No.: US 8,677,886 B2
(45) Date of Patent: Mar. 25, 2014

(54) HIGH RESPONSE HYDRAULIC ACTUATOR

(75) Inventors: Michael G. Cronin, Peoria, IL (US); Brian Mintah, Washington, IL (US); Benjamin T. Nelson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 860 days.

(21) Appl. No.: 12/883,262

(22) Filed: Sep. 16, 2010

(65) Prior Publication Data

US 2011/0094214 A1 Apr. 28, 2011

Related U.S. Application Data

(60) Provisional application No. 61/254,786, filed on Oct. 26, 2009.

(51) Int. Cl.
*F04B 1/32* (2006.01)

(52) U.S. Cl.
USPC ..... 92/12.2; 91/505

(58) Field of Classification Search
USPC ..... 92/12.1, 12.2, 13.1; 60/434, 487, 492; 91/504, 505, 506, 471, 519
See application file for complete search history.

(56) References Cited

U.S. PATENT DOCUMENTS

| | | | | |
|---|---|---|---|---|
| 3,429,225 | A * | 2/1969 | Keyworth | 91/3 |
| 3,672,793 | A * | 6/1972 | Yowell | 417/368 |
| 3,739,974 | A * | 6/1973 | Kiwalle et al. | 417/222.1 |
| 3,983,908 | A | 10/1976 | Bartholomaeus | |
| 4,478,136 | A | 10/1984 | Heiser et al. | |
| 5,406,878 | A | 4/1995 | Freeman et al. | |
| 5,440,878 | A * | 8/1995 | Gleasman et al. | 91/506 |
| 5,673,606 | A | 10/1997 | Rose et al. | |
| 6,076,552 | A | 6/2000 | Takahashi et al. | |
| 6,553,891 | B2 * | 4/2003 | Fiebing et al. | 92/12.2 |
| 7,299,738 | B2 | 11/2007 | Thoms et al. | |
| 7,334,513 | B2 * | 2/2008 | Belser | 92/12.2 |
| 7,367,258 | B2 * | 5/2008 | Wanschura et al. | 92/12.2 |
| 7,380,492 | B2 | 6/2008 | Thoms et al. | |
| 8,024,925 | B2 * | 9/2011 | Cronin | 60/451 |
| 8,074,558 | B2 * | 12/2011 | Knussman et al. | 92/12.2 |
| 8,165,765 | B2 * | 4/2012 | DeMarco et al. | 701/58 |

* cited by examiner

*Primary Examiner* — Thomas E Lazo
(74) *Attorney, Agent, or Firm* — Jonathan V. Trousdale

(57) ABSTRACT

A hydraulic actuator for pump control is disclosed. The hydraulic actuator includes two hydraulically isolated chambers for actuation in one direction and two hydraulically isolated chambers for actuation in an opposite direction. Each of the four chambers is connected to a source of high pressure fluid by an electronically controlled pressure reducing valve.

20 Claims, 3 Drawing Sheets

HIGH RESPONSE HYDRAULIC ACTUATOR

RELATED APPLICATIONS

This application is based upon and claims the benefit of priority from U.S. Provisional Application No. 61/254,786 by Michael G. Cronin et al., filed Oct. 26, 2009, the contents of which are expressly incorporated herein by reference.

TECHNICAL FIELD

The present disclosure relates generally to a hydraulic actuator, and more particularly, to a high response hydraulic actuator for controlling a variable displacement pump.

BACKGROUND

Variable displacement hydraulic pumps are widely used in hydraulic systems to provide pressurized hydraulic fluid for various applications. Many types of machines such as dozers, loaders, and the like, rely heavily on hydraulic systems to operate, and utilize variable displacement pumps to provide a greater degree of control over fixed displacement pumps.

Various control schemes have been utilized to control the swashplate angle of such variable displacement hydraulic pumps. One such control scheme is disclosed in U.S. Pat. No. 6,553,891, filed Jul. 9, 2001, to Carsten Fiebing, which is hereby incorporated by reference. However, it may be beneficial to provide a control scheme offering greater responsiveness and stability.

SUMMARY OF THE INVENTION

In one aspect of the disclosure, a hydraulic system includes a source of pressurized fluid; a hydraulic actuator; and first and second hydraulically isolated chambers configured to expand and contract, wherein expansion of the first and second chamber actuates the actuator in a first direction. The hydraulic system further includes third and fourth hydraulically isolated chambers configured to expand and contract, wherein expansion of the third and fourth chamber actuates the actuator in a second direction opposite the first direction. Each of the chambers has an associated pressure reducing valve that selectively communicates the respective chamber with either a source of pressurized fluid or a tank.

In another aspect, a variable displacement hydraulic device is disclosed having a swashplate; a hydraulic actuator operable to selectively increase and decrease an inclination of the swashplate; a first chamber configured to expand and contract, wherein expansion of the first chamber actuates the actuator in a first direction; a first valve fluidly connected to the first chamber, wherein the first valve selectively communicates pressurized fluid with the first chamber; and a second chamber configured to expand and contract, wherein expansion of the second chamber actuates the actuator in the first direct. According to this aspect, the first chamber and the second chamber are substantially hydraulically isolated.

DETAILED DESCRIPTION

Figure 1:
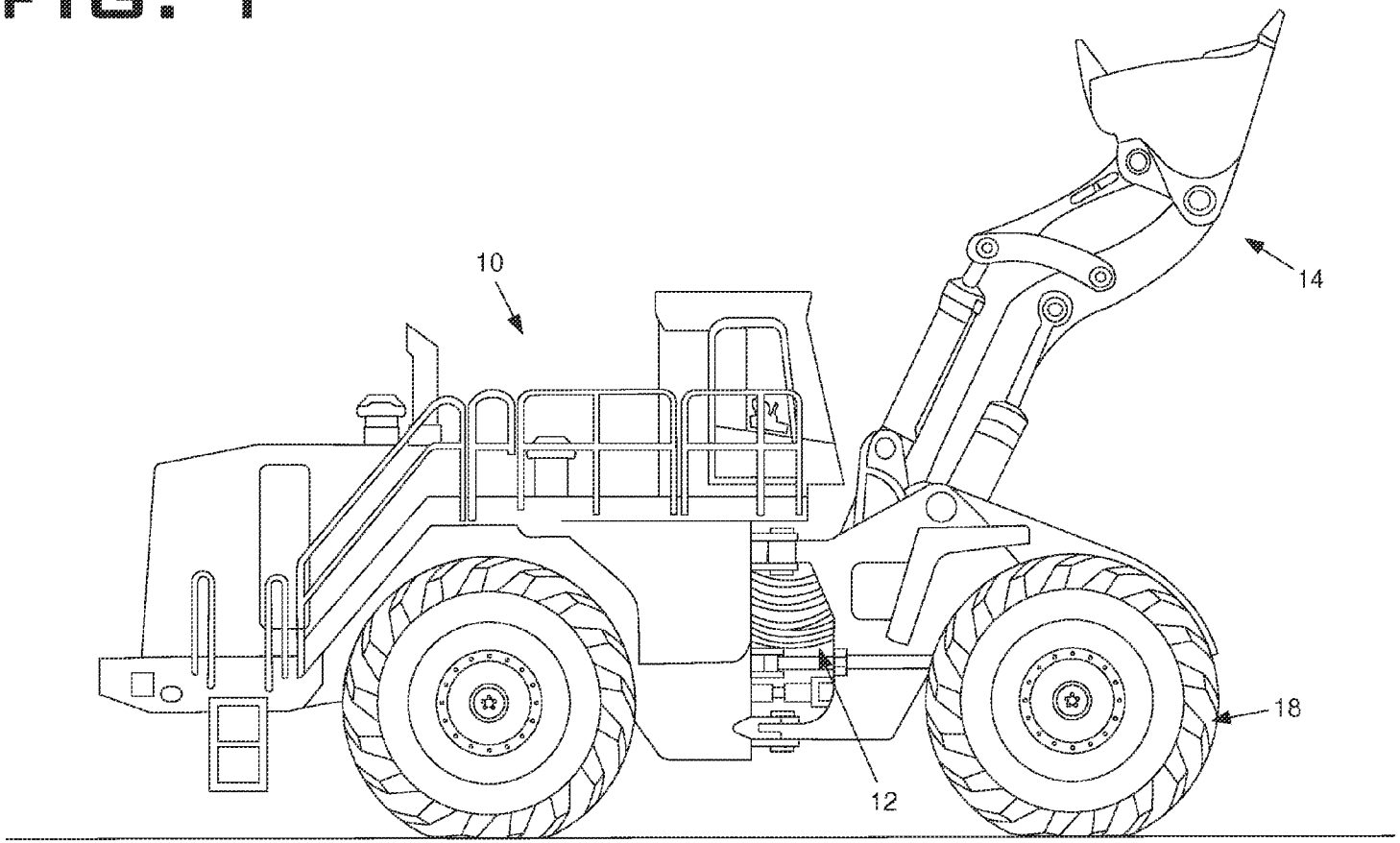
FIG. 1 is a side-view diagrammatic illustration of an exemplary disclosed machine.
Figure 2:
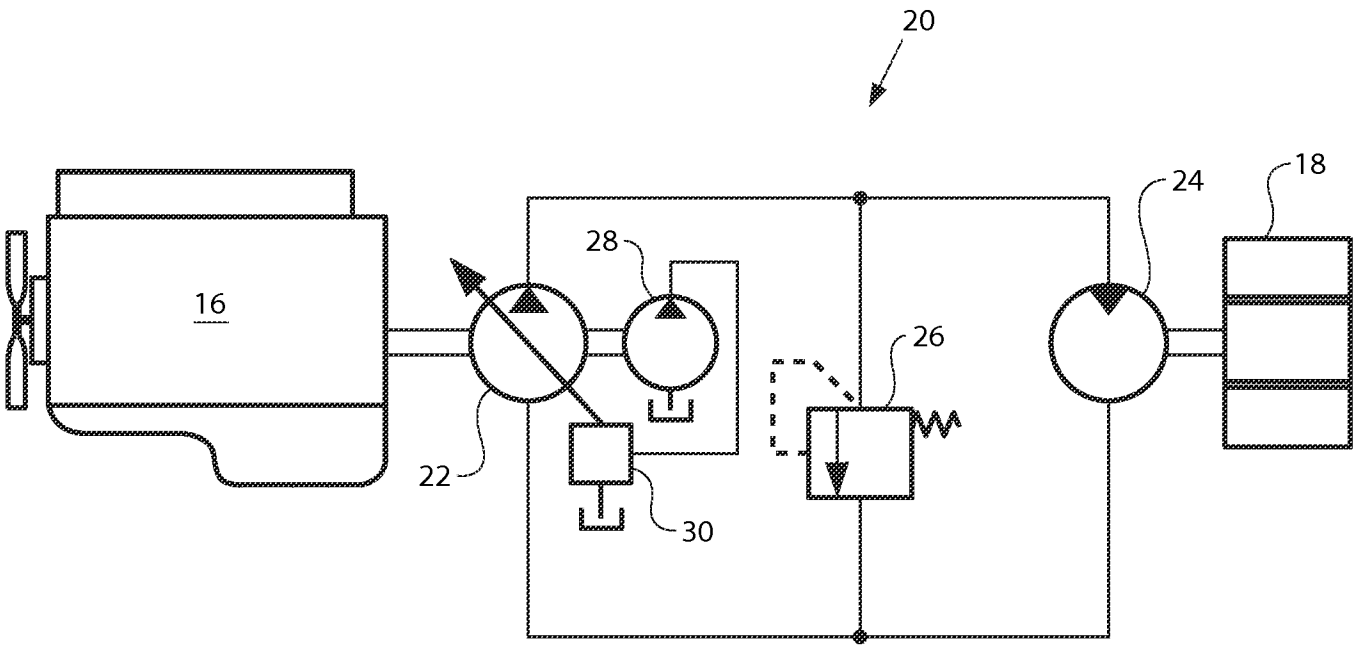
FIG. 2 is a schematic illustration of an exemplary disclosed transmission.

FIG. 1 illustrates an exemplary machine 10. Machine 10 may be a fixed or mobile machine that performs operations associated with an industry such as mining, construction, farming, or any other industry known in the art. For example, machine 10 may be an earth moving machine such as a dozer, a loader, a backhoe, an excavator, a motor grader, a dump truck, or any other earth moving machine. Machine 10 may also embody a generator set, a pump, a marine vessel, or any other suitable machine. Referring to FIGS. 1 and 2, machine 10 may include a frame 12, an implement 14, a hydraulic actuator, an engine 16, fraction devices 18 such as wheels or tracks, and a transmission 20 to transfer power from the engine 16 to the traction devices 18.

As illustrated in FIG. 2, the transmission 20 may be a hydrostatic transmission and may include a primary pump 22, a motor 24 and a bypass relief valve 26. In practice, transmission may be a continuously variable transmission (CVT), parallel path variable transmission (PPV), or other transmission known in the art. According to the present disclosure, the main pump 22 may be a variable displacement pump such as a variable displacement axial piston pump, and the motor 24 may be a fixed displacement hydraulic motor. However, the motor 24 may alternatively be a variable displacement motor. The transmission 20 may further include a charge pump 28 providing pressurized fluid to swashplate control hardware 30, which is illustrated in greater detail in FIG. 3.

Figure 3:
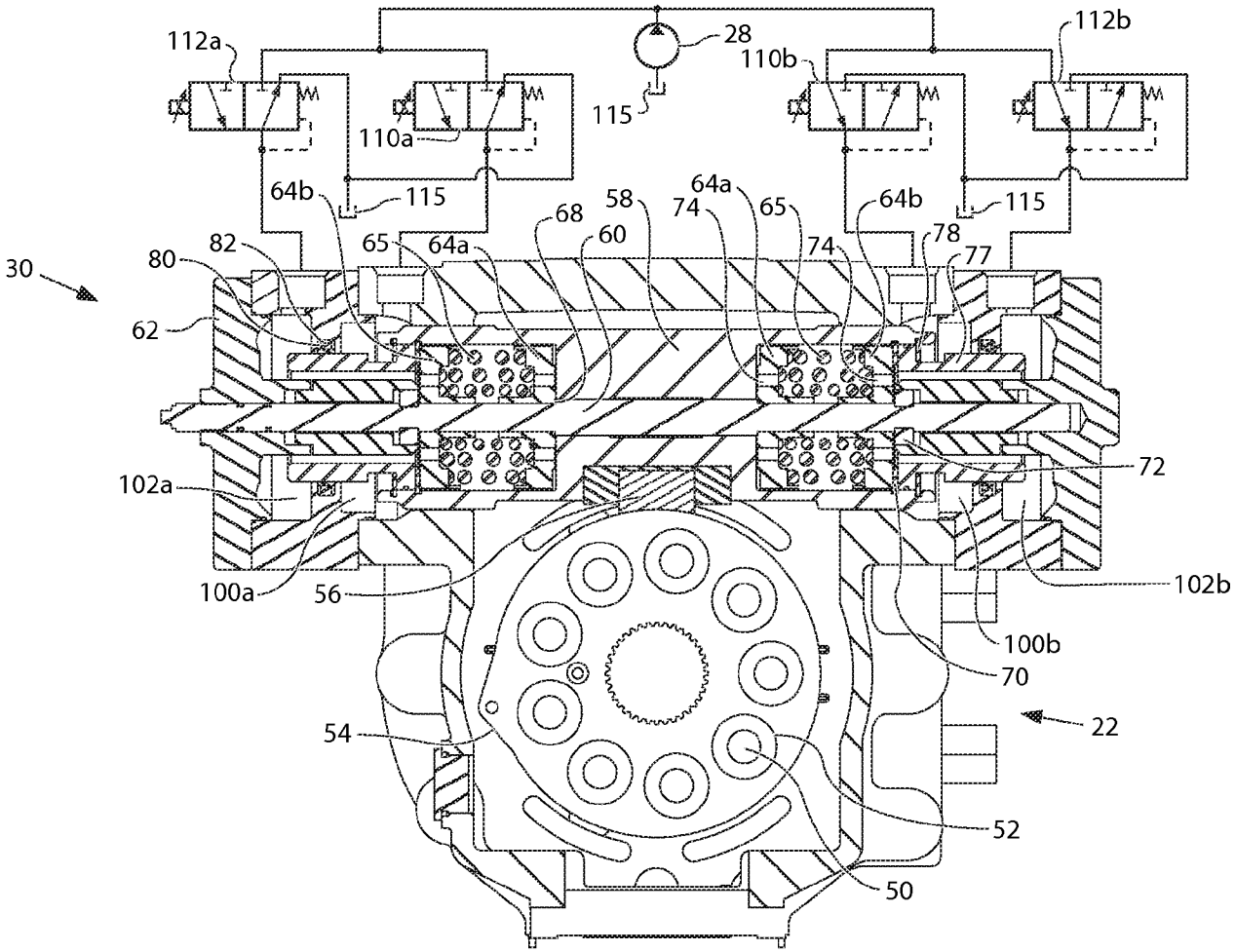
FIG. 3 is a schematic illustration of an exemplary disclosed hydraulic pump and associated control hardware.

FIG. 3 illustrates the primary pump 22, which includes pistons 50 disposed in a cylinder block 52. The pistons 50 are slidably supported by swashplate 54, and swashplate 54 has a variable angle of inclination that affects the displacement of the pistons 50 for each revolution of the pump 22. In the illustrated embodiment, swashplate 54 is connected to an actuation arm 56 that is, in turn, connected to an actuation member 58. Movement of actuation arm 56 may effect a change in the inclination of swashplate 54. For example, moving actuation arm 56 to the left, with respect to FIG. 3, may increase the inclination of swashplate 56, whereas moving actuation arm 56 to the right, with respect to FIG. 3, may decrease the inclination of swashplate 54. Actuation member 58 is slidable about a shaft 60, which is fixed with respect to the pump housing 62.

As seen in FIG. 3, many components of the swashplate control hardware 30 may be similar on both the left and right sides of the pump 22; such similar components may be denoted with common reference numbers. Disposed within actuation member are proximal spring retainers 64*a* and distal spring retainers 64*b*, which together enclose springs 65. Proximal spring retainer members 64*a* may be slidable about shaft 60, but may be constrained from sliding toward the center of the shaft 60 by a lip 68 on the shaft 60. Distal spring retainers 64*b* may be slidable about shaft 60, but constrained from movement away from the center of actuation member 58 by a restraining ring 70, and constrained from movement away from the center of shaft 60 by another restraining ring 72. Both proximal spring retainers 64*a* and distal spring retainers 64*b* may include fluid passageways 74 to allow fluid to pass through the spring retainers 64*a*, 64*b*.

A cap member 77 may further be partially disposed in actuation member 58. In the illustrated embodiment, cap member 77 is constrained from movement with respect to actuation member 58 by restraining ring 70 and restraining ring 78. Cap member 77 also passes through a restrictive portion 80 of pump housing 62, and is surrounded by a seal 82 at the restrictive portion 80.

In the illustrated embodiment, with respect to the left side of the pump 22 in FIG. 3, seal 82 defines a boundary between interior chamber 100*a* and anterior chamber 102*a*. With respect to the right side of the pump 22 in FIG. 3 seal 82 defines a boundary between interior chamber 100*b* and anterior chamber 102*b*. In the illustrated embodiment, each chamber 100*a*, 100*b*, 102*a*, 102*b* is selectively connected to charge pump 28 by a pressure reducing valves 110*a*, 110*b*, 112*a*, 112*b*, respectively. The use of pressure reducing valves to control the displacement of a variable displacement pump is discussed in U.S. patent application Ser. No. 11/269,392 to Michael Cronin (Pub. No. 2007/0101709), which is hereby incorporated by reference. As illustrated, pressure reducing valves 110*a*, 110*b*, 112*a*, 112*b* may be infinitely variable, three way valves that selectively communicate their respective chamber 100*a*, 100*b*, 102*a*, 102*b* with either the charge pump 28 or tank 115. Furthermore, pressure reducing valves 110*a*, 110*b*, 112*a*, 112*b* may be electronic pressure reducing valves and may be selectively actuated by solenoids.

INDUSTRIAL APPLICABILITY

In operation, swashplate 54 inclination can be changed by moving actuation member 58, and hence actuation arm 56. Actuation member 58 can be moved by selectively directing pressurized fluid in and out of chambers 100*a*, 100*b*, 102*a*, 102*b*. For example, with reference to FIG. 3, to move actuation member 58 to the left, the solenoids corresponding to pressure reducing valve 110*b* and pressure reducing valve 112*b* may be energized such that pressurized fluid from charge pump 28 is passed to both interior chamber 100*b* and anterior chamber 102*b*, thereby causing both chambers to expand. The expansion of chambers 100*b*, 102*b* actuates actuation member 58 to the left. While some leakage may pass between the anterior chamber 102*b* and interior chamber 100*b*, seal 82 causes interior chamber 100*b* to be substantially hydraulically isolated from anterior chamber 102*b*. As flow is passed through two valves 110*b*, 112*b*, actuation member 58 can be actuated more quickly because pressurized fluid can be provided through the two valves 110*b*, 112*b* at a higher combined rate than a similar system having only a single valve of similar size that must effectively provide fluid to both chambers. Furthermore, as the two chambers 100*b*, 102*b* are substantially hydraulically isolated, interference and cross-talking between the two valves 110*b*, 112*b* may be reduced or avoided.

To further the example discussed above, to move actuation member 58 to the left, the solenoids corresponding to pressure reducing valve 110*a* and pressure reducing valve 112*a* may be de-energized such that fluid in interior chamber 100*a* and anterior chamber 102*a* can flow to tank 115, causing these chambers 100*a*, 102*a* to contract, which permits actuation member 58 to move left. In a similar manner, actuation member 58 may be moved to the right by energizing solenoids associated with pressure reducing valve 110*a* and pressure reducing valve 112*a*, and de-energizing solenoids associated with pressure reducing valve 110*b* and pressure reducing valve 112*b*.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system comprising:

a source of pressurized fluid;

a hydraulic actuator;

a first chamber configured to expand and contract, wherein expansion of the first chamber actuates the actuator in a first direction;

a first pressure reducing valve fluidly connected between the first chamber and the source;

a second chamber configured to expand and contract, wherein expansion of the second chamber actuates the actuator in the first direction, the second chamber being substantially hydraulically isolated from the first chamber;

a second pressure reducing valve fluidly connected between the second chamber and the source;

a third chamber configured to expand and contract, wherein expansion of the third chamber actuates the actuator in a second direction, the second direction being opposite to the first direction;

a third pressure reducing valve fluidly connected between the third chamber and the source;

a fourth chamber configured to expand and contract, wherein expansion of the fourth chamber actuates the actuator in the second direction, the fourth chamber being substantially hydraulically isolated from the third chamber; and a fourth pressure reducing valve fluidly connected between the fourth chamber and the source.

2. The hydraulic system of claim 1 further including a variable displacement hydraulic pump having a swashplate, wherein the actuator is configured to control an inclination of the swashplate; and wherein the source is one of the variable displacement hydraulic pump or a charge pump.

3. The hydraulic system of claim 2, wherein the source is the charge pump.

4. The hydraulic system of claim 2, wherein actuation of the actuator in the first direction increases the inclination of the swashplate.

5. The hydraulic system of claim 4, wherein actuation of the actuator in the second direction decreases the inclination of the swashplate.

6. The hydraulic system of claim 1, wherein the first pressure reducing valve is controlled by a solenoid.

7. A variable displacement hydraulic device comprising:

a swashplate;

a hydraulic actuator operable to selectively increase and decrease an inclination of the swashplate;

a first chamber configured to expand and contract, wherein expansion of the first chamber actuates the actuator in a first direction;

a first valve fluidly connected to the first chamber, wherein the first valve selectively communicates pressurized fluid with the first chamber; and a second chamber configured to expand and contract, wherein expansion of the second chamber actuates the actuator in the first direction, wherein the first chamber and the second chamber are substantially hydraulically isolated.

8. The hydraulic device of claim 7 further comprising a second valve fluidly connected to the second chamber, wherein the second valve selectively communicates pressurized fluid with the second chamber.

9. The hydraulic device of claim 8, wherein the first valve and the second valve are pressure reducing valves.

10. The hydraulic device of claim 8, wherein the first valve is controlled by a solenoid.

11. The hydraulic device of claim 8 further comprising a third chamber configured to expand and contract, wherein expansion of the third chamber actuates the actuator in a second direction, the second direction being opposite to the first direction.

12. The hydraulic device of claim 11 further comprising a third valve fluidly connected to the third chamber, wherein the third valve selectively communicates pressurized fluid to the third chamber.

13. The hydraulic device of claim 12 further comprising a fourth chamber configured to expand and contract, wherein expansion of the fourth chamber actuates the actuator in the second direction, and the fourth chamber is substantially hydraulically isolated from the third chamber.

14. The hydraulic device of claim 13 wherein actuation of the actuator in the first direction increases the inclination of the swashplate, and actuation of the actuator in the second direction decreases the inclination of the swashplate.

15. The hydraulic device of claim 7 further comprising a charge pump, wherein the charge pump provides pressurized fluid to the first chamber and the second chamber.

16. A method for controlling an inclination of a swashplate comprising the step:

Step 1: increasing the inclination of the swashplate by providing pressurized fluid to a first chamber via a first pressure reducing valve, and providing pressurized fluid to a second chamber via a second pressure reducing valve, wherein the first chamber is substantially hydraulically isolated from the second chamber.

17. The method of claim 16 further comprising:

Step 2: decreasing the inclination of the swashplate by communicating the first chamber with a tank via the first pressure reducing valve, and communicating the second chamber with the tank via the second pressure reducing valve.

18. The method of claim 17 wherein Step 1 further comprises communicating a third chamber with the tank via a third pressure reducing valve, and communicating a fourth chamber with the tank via a fourth pressure reducing valve, wherein the third chamber is substantially hydraulically isolated from the fourth chamber.

19. The method of claim 18 wherein Step 2 further comprises providing pressurized fluid to the third chamber via the third pressure reducing valve, and providing pressurized fluid to the fourth chamber via the fourth pressure reducing valve.

20. The method of claim 19, wherein the first, second, third and fourth pressure reducing valves are each controlled by respective solenoids.

* * * * *